US007832226B2

(12) United States Patent
Nakamura

(10) Patent No.: US 7,832,226 B2
(45) Date of Patent: Nov. 16, 2010

(54) INDOOR UNIT OF AN AIR CONDITIONER AND METHOD FOR MANUFACTURING INDOOR UNIT OF AN AIR CONDITIONER

(75) Inventor: Junji Nakamura, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1248 days.

(21) Appl. No.: 10/565,393

(22) PCT Filed: Aug. 23, 2004

(86) PCT No.: PCT/JP2004/012060

§ 371 (c)(1),
(2), (4) Date: Jan. 23, 2006

(87) PCT Pub. No.: WO2005/022045

PCT Pub. Date: Mar. 10, 2005

(65) Prior Publication Data

US 2006/0179865 A1 Aug. 17, 2006

(30) Foreign Application Priority Data

Aug. 29, 2003 (JP) ..... 2003-307095

(51) Int. Cl.
*F25B 45/00* (2006.01)

(52) U.S. Cl. ..... 62/298

(58) Field of Classification Search ..... 62/298, 62/262; 425/90
See application file for complete search history.

(56) References Cited

U.S. PATENT DOCUMENTS

| | | | | | |
|---|---|---|---|---|---|
| 3,999,475 | A | * | 12/1976 | Roderick | 99/474 |
| 4,095,440 | A | * | 6/1978 | Brown et al. | 62/450 |
| 5,058,393 | A | * | 10/1991 | Callon et al. | 62/255 |
| 5,458,407 | A | * | 10/1995 | Bustos et al. | 312/116 |
| 5,461,878 | A | * | 10/1995 | Moore et al. | 62/255 |
| 5,502,979 | A | * | 4/1996 | Renard | 62/256 |
| 6,725,684 | B2 | | 4/2004 | Lee et al. | |
| 2002/0189274 | A1 | | 12/2002 | Lee et al. | |
| 2003/0145618 | A1 | | 8/2003 | Moon et al. | |

FOREIGN PATENT DOCUMENTS

| | | |
|---|---|---|
| EP | 1271065 | 1/2003 |
| JP | 03-213921 A | 9/1991 |
| JP | 2000-106790 | 4/2000 |
| JP | 2000-161706 | 6/2000 |
| JP | 2002-089892 | 3/2002 |
| JP | 2002-098352 A | 4/2002 |
| JP | 2003-014249 | 1/2003 |
| JP | 2003-322355 | 11/2003 |
| WO | WO 02/103248 | 12/2002 |

* cited by examiner

*Primary Examiner*—Melvin Jones
(74) *Attorney, Agent, or Firm*—Global IP Counselors

(57) ABSTRACT

An indoor unit of an air conditioner includes a front panel and a coating layer. A first panel and a second panel of the front panel are formed from a transparent material in which luminous grains are mixed. The coating layer exhibits a color scheme or a pattern, and is provided to a reverse side of the first panel and the second panel.

9 Claims, 6 Drawing Sheets

INDOOR UNIT OF AN AIR CONDITIONER AND METHOD FOR MANUFACTURING INDOOR UNIT OF AN AIR CONDITIONER

CROSS-REFERENCE TO RELATED APPLICATIONS

This U.S. National stage application claims priority under 35 U.S.C. §119(a) to Japanese Patent Application No. 2003-307095 filed in Japan on Aug. 29, 2003 the entire contents of which are hereby incorporated herein by reference.

FIELD OF THE INVENTION

The present invention relates to an indoor unit of an air conditioner, and a method for manufacturing an indoor unit of an air conditioner.

RELATED ART

Indoor units of air conditioners comprise a heat exchanger, a ventilation fan, and other such structural components, and the units also comprise a casing that constitutes the outward appearance of the indoor unit (see Japanese Patent Publication No. 2002-89892). The casing can be seen by the occupants and the like because the indoor unit is disposed indoors. Consequently, the casing is often given a color scheme, pattern, or other design. The aesthetics of the indoor unit of the air conditioner can thereby be improved. Such casings then do not merely exhibit simple color schemes or patterns, but sometimes exhibit luminous designs.

SUMMARY OF THE INVENTION

The present inventors have previously proposed the following method as a method for manufacturing an indoor unit of an air conditioner that exhibits a luminous design as described above. First, a casing is formed from a transparent resin or another such transparent material, and the reverse side of the transparent casing is coated with pearls or other such luminous grains. After the casing is coated with the grains, a base coating is applied. An indoor unit of an air conditioner that exhibits a luminous design can be manufactured by such a method for manufacturing an indoor unit of an air conditioner.

However, in this method for manufacturing an indoor unit of an air conditioner, a coating of luminous grains must be applied in addition to the base coating, and a greater number of manufacturing steps is involved than with an indoor unit of an air conditioner in which a regular coating without luminosity is applied.

It is an object of the present invention to reduce the number of manufacturing steps for an indoor unit of an air conditioner that exhibits a luminous design.

An indoor unit of an air conditioner as recited in a first aspect of the present invention includes a casing and a design layer. At least a specific part of the casing is formed from a transparent material in which luminous grains are admixed. The design layer exhibits a color scheme or a pattern and is provided to the reverse side of the specific part.

In this indoor unit of an air conditioner, at least a specific part of the casing is formed from a transparent material in which luminous grains are admixed. Consequently, the step of coating the reverse side of the casing with luminous grains can be omitted from the steps of manufacturing the indoor unit of the air conditioner. The number of steps for manufacturing the indoor unit of an air conditioner that exhibits a luminous design can thereby be reduced.

An indoor unit of an air conditioner as recited in a second aspect of the present invention is the indoor unit of an air conditioner as recited the first aspect of the present invention, wherein the specific part is disposed on the front side.

In this indoor unit of an air conditioner, the specific part is disposed on the front side. The front side of the indoor unit of the air conditioner is in a position where it can be particularly easily seen by the occupants. Accordingly, the aesthetics of the indoor unit of the air conditioner can be further improved by disposing the specific part displaying a luminous design on the front side.

An indoor unit of an air conditioner as recited in a third aspect of the present invention is the indoor unit of an air conditioner as recited in the second aspect of the present invention, wherein the front side of the specific part is formed to be substantially flat.

In this indoor unit of an air conditioner, the front side of the specific part is formed to be substantially flat. Consequently, the aesthetics of the indoor unit of the air conditioner can be further improved by the flat shape and the luminous design.

An indoor unit of an air conditioner as recited in a fourth aspect of the present invention is the indoor unit of an air conditioner as recited in any one of the first through third aspects of the present invention, wherein the casing has a casing main body that is formed from a nontransparent material separately from the specific part.

In this indoor unit of an air conditioner, the casing has a casing main body that is formed separately from the specific part exhibiting a luminous design, and this casing main body is formed from a nontransparent material. When all the parts of the casing are formed from transparent materials, the required costs of the materials may increase. However, this indoor unit of an air conditioner has a casing main body formed from a nontransparent material and a specific part formed from a transparent material. Therefore, the aesthetics of the indoor unit of the air conditioner can be improved and costs reduced.

An indoor unit of an air conditioner as recited in a fifth aspect of the present invention is the indoor unit of an air conditioner as recited in any one of the first through fourth aspects of the present invention, wherein the design layer exhibits a luminous color scheme.

In this indoor unit of an air conditioner, the design layer exhibits a luminous color scheme. Consequently, the luminosity can be further enhanced by combining the luminous grains admixed in the transparent material with the luminous color scheme of the design layer.

A method for manufacturing an indoor unit of an air conditioner as recited in a sixth aspect of the present invention includes a first step and a second step. In the first step, at least a specific part of a casing is formed from a transparent material in which luminous grains have been admixed. In the second step, a design layer that exhibits a color scheme or a pattern is formed on the reverse side of the specific part.

In this method for manufacturing an indoor unit of an air conditioner, at least the specific part of a casing is formed from a transparent material in which luminous grains have been admixed. Consequently, the step of coating the reverse side of the casing with luminous grains can be omitted. The number of steps for manufacturing an indoor unit of an air conditioner that exhibits a luminous design can thereby be reduced.

DETAILED DESCRIPTION OF THE PREFERRED EMBODIMENTS

Air Conditioner Overall Constitution

Figure 1:
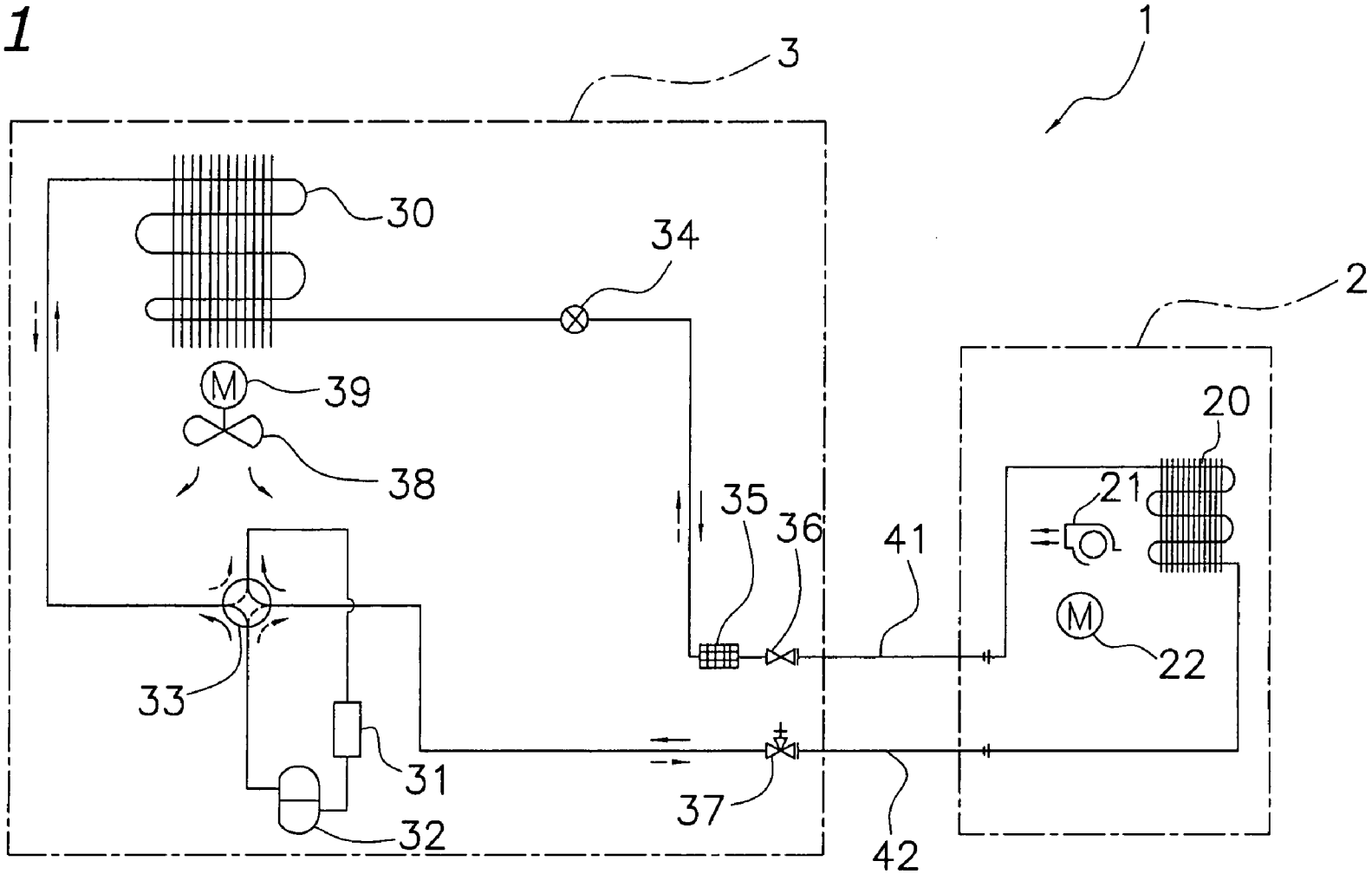
FIG. 1 schematically depicts the constitution of the air conditioner and a refrigerant circuit.

FIG. 1 schematically depicts the constitution of an air conditioner 1 and the refrigerant circuit according to the first embodiment of the present invention.

This air conditioner 1 comprises an indoor unit 2 attached to a wall surface or the like in the room, and an outdoor unit 3 installed outdoors.

The refrigerant circuit of this air conditioner 1 principally comprises an indoor heat exchanger 20, an accumulator 31, a compressor 32, a four-way switching valve 33, an outdoor heat exchanger 30, and a motor-operated expansion valve 34.

The indoor heat exchanger 20 provided to the indoor unit 2 exchanges heat with the air with which it comes in contact. In addition, the indoor unit 2 is provided with an indoor fan 21 that sucks in the indoor air, passes it through the indoor heat exchanger 20, exchanges heat with the air, and then discharges the air into the room. An indoor fan motor 22 provided inside the indoor unit 2 rotatably drives the indoor fan 21. These structural components are housed in an indoor unit casing 4. The indoor unit casing 4 will be explained in detail later.

The outdoor unit 3 comprises the compressor 32, the four-way switching valve 33 connected to the discharge side of the compressor 32, the accumulator 31 connected to the inlet side of the compressor 32, the outdoor heat exchanger 30 connected to the four-way switching valve 33, and the motor-operated expansion valve 34 connected to the outdoor heat exchanger 30. The motor-operated expansion valve 34 is connected to a piping 41 via a filter 35 and a liquid shutoff valve 36, and is connected to one end of the indoor heat exchanger 20 via this piping 41. In addition, the four-way switching valve 33 is connected to a piping 42 via a gas shutoff valve 37, and is connected to the other end of the indoor heat exchanger 20 via this piping 42. In addition, the outdoor unit 3 comprises an outdoor fan 38 for externally discharging the air after its heat has been exchanged by the outdoor heat exchanger 30. An outdoor fan motor 39 rotatably drives this outdoor fan 38.

Indoor Unit Casing Constitution

Figure 2:
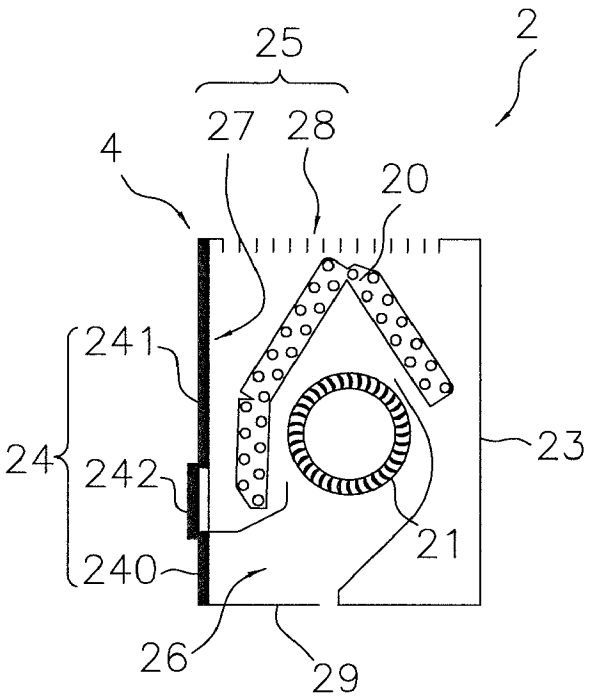
FIG. 2(*a*) is a front view of the indoor unit, and FIG. 2(*b*) is a side cross sectional view of the indoor unit.
Figure 2:
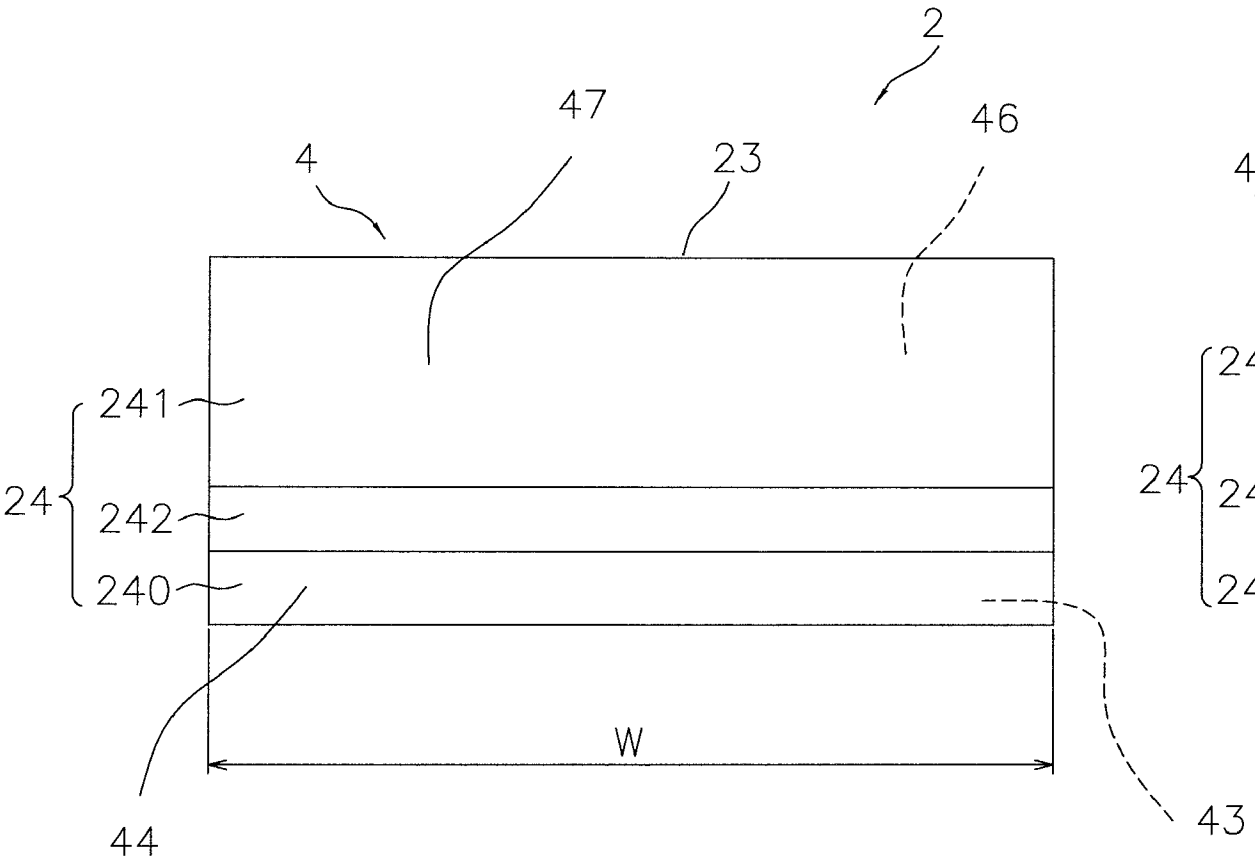

FIG. 2(*a*) depicts a front view of the indoor unit 2, and FIG. 2(*b*) depicts a side cross sectional view of the indoor unit 2. FIG. 2(*a*) and FIG. 2(*b*) depict the indoor unit 2 when operation stops.

The indoor unit 2 is a wall-mounted indoor unit provided on a side wall of a room, and this unit comprises an indoor unit casing 4. The indoor unit casing 4 comprises a casing main body 23, and a front panel 24 formed separately from the casing main body 23.

Casing Main Body

The casing main body 23 is molded from a nontransparent resin material in a shape of a thin rectangular parallelepiped. The casing main body 23 has a long, substantially rectangular shape in the horizontal direction as viewed from the front, and has a long rectangular cross sectional shape in the vertical direction as viewed from a side. The inside of the casing main body 23 comprises the above-discussed indoor heat exchanger 20, the indoor fan 21, the indoor fan motor 22 (not shown), and the like. As depicted in FIG. 2(*b*), in a side view, the indoor fan 21 is disposed in the center of the casing main body 23, and the indoor heat exchanger 20 having an inverted V shape is disposed so that it surrounds the upper half of the indoor fan 21. In addition, the casing main body 23 comprises an inlet 25 and an outlet 26.

The inlet 25 is an opening through which passes the air taken in by the indoor fan 21 from the room into the casing main body 23, and comprises a first inlet 27 and a second inlet 28. The first inlet 27 has a long shape in the horizontal direction as viewed from the front, and its length is slightly less than the width W of the casing main body 23. As depicted in FIG. 2(*b*), the first inlet 27 is provided in the vicinity of the center in the front surface of the casing main body 23, opposing the front side of the indoor heat exchanger 20. The first inlet 27 is closed by a second panel 241 of the front panel 24, to be described later, when the operation of the indoor unit 2 stops. The second inlet 28 comprises a plurality of long slits in the longitudinal direction of the casing main body 23, and is provided in the top surface of the casing main body 23.

The outlet 26 is an opening through which passes the air blown out by the indoor fan 21 through the indoor heat exchanger 20 into the room. The outlet 26 has a long shape in the horizontal direction as viewed from the front, and its length is slightly less than the width W of the casing main body 23. In addition, the outlet 26 is in the vicinity of the lower part of the casing main body 23, and is provided in the front surface of the casing main body 23. When the operation of the indoor unit 2 stops, the outlet 26 is closed by a first panel 240 of the front panel 24, to be described later.

In addition, a horizontal flap 29 is provided in the vicinity of the outlet 26. The horizontal flap 29 is a plate-shaped member having a long shape in the longitudinal direction of the indoor unit 2, and guides air blown out from the outlet 26. The horizontal flap 29 has a rotational axis parallel to the longitudinal direction of the indoor unit 2, and rotates about the rotational axis, thereby modifying the direction in which the air is guided.

Front Panel

The front panel 24 covers nearly the entire front surface of the casing main body 23. The front panel 24 also covers the outlet 26 and the first inlet 27 as viewed from the front, and opens and closes the outlet 26 and the first inlet 27. The front panel 24 is a panel assembly obtained by assembling a seamless plurality of panels 240-242, and has a first panel 240, a second panel 241, and a third panel 242.

Figure 3:
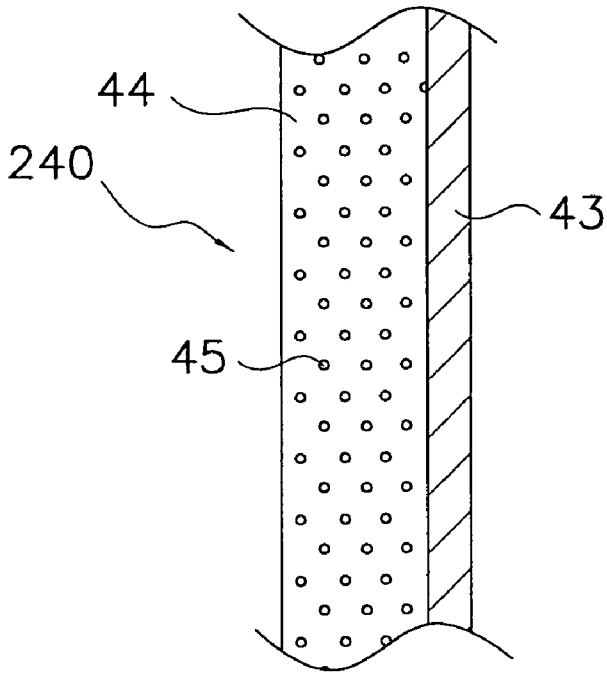
FIG. 3(*a*) is an enlarged side cross sectional view of a first panel, and FIG. 3(*b*) is an enlarged side cross sectional view of a second panel.
Figure 3:
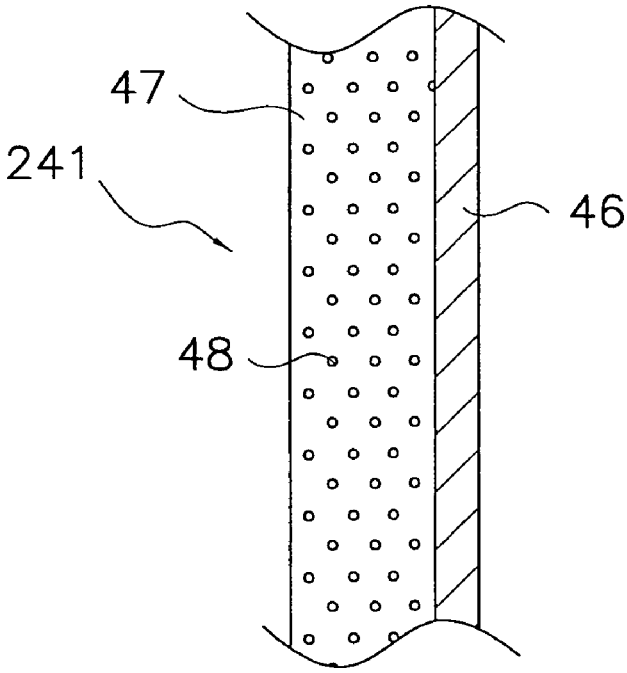

The first panel 240 is disposed at the lower part of the front surface of the casing main body 23. The first panel 240 is supported while capable of being moved in the vertical direction in a parallel fashion by a moving mechanism (not shown), and the panel opens and closes the outlet 26. The first panel 240 is a rectangular plate-shaped member having no seams, whose width is substantially the same as the width W of the casing main body 23 as viewed from the front. The front side of the first panel 240 is formed into a smooth, substantially flat shape with no concavities or convexities and with no holes or slits or other such openings. In the state wherein the outlet 26 is closed, the first panel 240 is in a state parallel to the vertical direction, as depicted in FIG. 2(*b*). In addition, in this state, the first panel 240 has a surface area in projection larger than the outlet 26 as viewed from the front. Accordingly, in the state wherein the outlet 26 is closed, the first panel 240 covers the entire lower half of the front surface of the casing main body 23, including the outlet 26. Also, the first panel 240 is molded from a transparent resin in which pearl grains or other such luminous grains 45 are admixed, and has a transparent resin layer 44 in which the grains 45 are admixed, as depicted in FIG. 3(*a*). The reverse side of the transparent resin layer 44 is provided with a coating layer 43 that exhibits a color scheme or a pattern or the like. This coating layer 43 is formed by applying a coating to the reverse side of the first panel 240. FIG. 3(*a*) is a side cross sectional enlarged view of the first panel 240.

The second panel 241 is disposed at the upper part of the front surface of the casing main body 23. The second panel 241 is movably supported by the moving mechanism (not shown), and the panel opens and closes the first inlet 27. The second panel 241 is a rectangular plate-shaped member having no seams, and has a width substantially the same as the width W of the casing main body 23, including the first inlet 27 as viewed from the front. The front side of the second panel 241 is formed into a smooth, substantially flat shape with no concavities or convexities and with no holes or slits or other such openings. In a state wherein the first inlet 27 is closed, the second panel 241 is in a state parallel to the vertical direction, as depicted in FIG. 2(*b*). The second panel 241 also has a surface area in projection larger than the first inlet 27 as viewed from the front. Accordingly, in a state wherein the first inlet 27 is closed, the second panel 241 covers the entire upper half of the front surface of the casing main body 23, including the first inlet 27. Also, the second panel 241 is molded from a transparent resin in which pearl grains or other such luminous grains 48 are admixed, and has a transparent resin layer 47 in which the grains 48 are admixed, as depicted in FIG. 3(*b*). The reverse side of the transparent resin layer 47 is provided with a coating layer 46 that exhibits a color scheme or a pattern or the like. This coating layer 46 is formed by applying a coating to the reverse side of the second panel 241. FIG. 3(*b*) is a side cross sectional enlarged view of the second panel 241.

Figure 4:
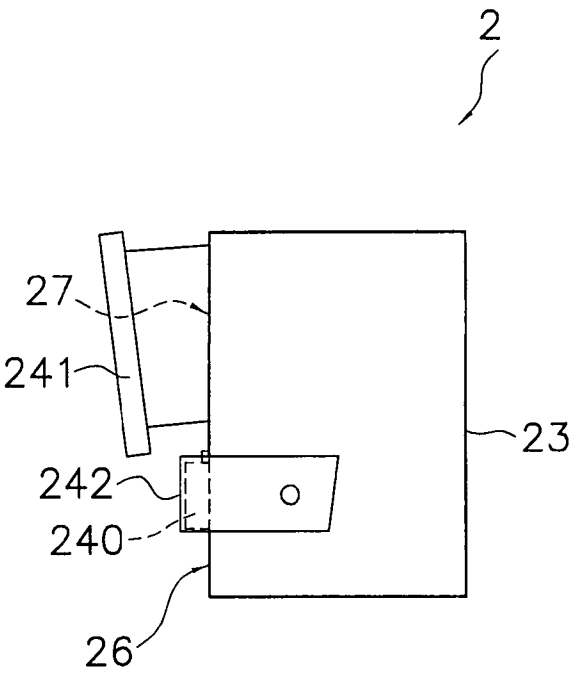
FIG. 4 is a side view of the indoor unit depicting the operation of the front panel when the operation is initiated.
Figure 4:
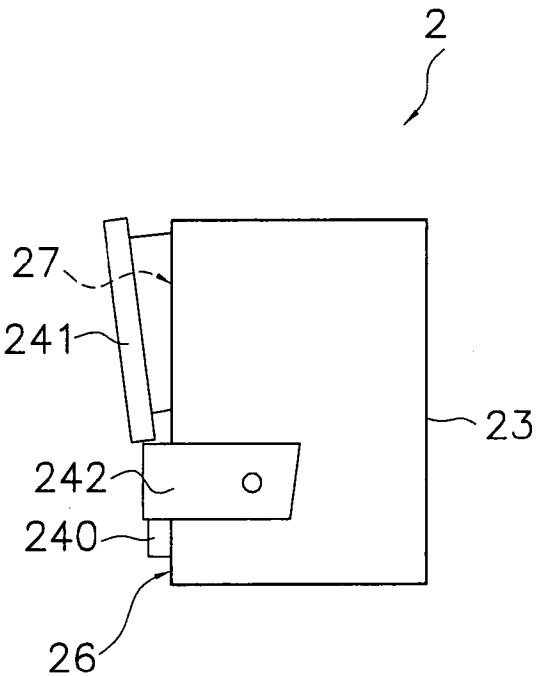
Figure 4:
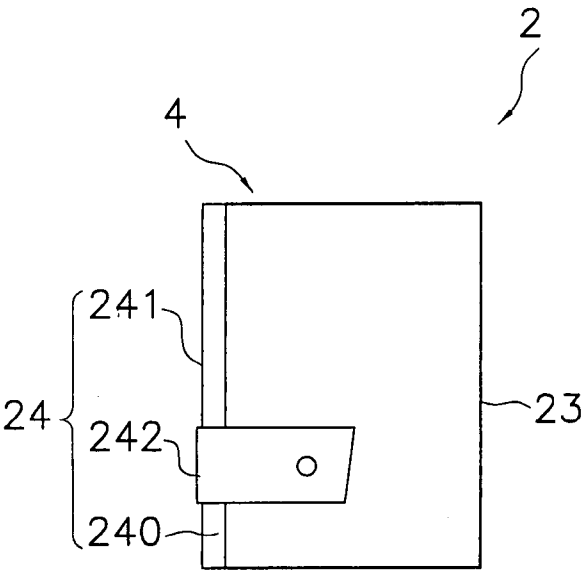

The third panel 242 is disposed between the first panel 240 and the second panel 241. The third panel 242 has a rectangular shape having no seams as viewed from the front. The third panel 242 has substantially the same width W as the indoor unit 2, and also has substantially the same length as the first panel 240 in the vertical direction. The front side of the third panel 242 is formed into a smooth, substantially flat shape with no concavities or convexities and with no holes or slits or other such openings. The third panel 242 is disposed so that the areas near the left and right ends are fixed in place to the left and right sides of the casing main body 23, and the front portion of the third panel 242 is disposed so that a gap is formed between the panel and the casing main body 23 in the longitudinal direction, as depicted in FIG. 4(*a*). Specifically, a gap is formed between the back of the third panel 242 and the casing main body 23. This gap is formed to be slightly larger than the thickness of the first panel 240 disposed in the lower half, and the gap constitutes a space for accommodating the first panel 240, which moves to open the outlet 26. The third panel 242 is also molded from a nontransparent resin material.

Thus, in a state wherein the outlet 26 is closed, the first panel 240 covers the entire lower half of the front surface of the casing main body 23, including the outlet 26; and in a state wherein the first inlet 27 is closed, the second panel 241 covers the entire upper half of the front surface of the casing main body 23, including the first inlet 27. In addition, the first panel 240, the second panel 241, and the third panel 242 are arrayed vertically, and are disposed so as to constitute a substantially flat rectangular surface when the outlet 26 and the first inlet 27 are closed. The front panel 24 constituted by the first panel 240, the second panel 241, and the third panel 242 covers substantially the entire front surface of the indoor unit 2 when the outlet 26 and the first inlet 27 are closed, and only the seams formed in the borders between the first panel 240, the second panel 241, and the third panel 242 can be seen in a front view. Specifically, only the seams that extend in the horizontal direction and are formed by the border between the first panel 240 and the third panel 242 and the border between the second panel 241 and the third panel 242, can be seen in a front view. Furthermore, the first panel 240, the second panel 241, and the third panel 242 are parallel to the vertical direction, and the front panel 24 forms a flat surface parallel to the vertical direction in a state wherein the outlet 26 and the first inlet 27 are closed. The aesthetics of the indoor unit 2 of the air conditioner 1 are improved as a result of the front panel 24 having such a flat shape.

Operation of the Front Panel at the Start of Operation

In a state wherein the operation of the indoor unit 2 stops, the front panel 24 closes the outlet 26 and the first inlet 27 as described above. When the indoor unit 2 operates, first the indoor fan 21 starts up at a low rotation. Next, the first panel 240 and the second panel 241 move and cause the outlet 26 and the first inlet 27 to open. A certain amount of airflow is thereby ensured to be taken into the indoor unit 2, and air is blown out in the horizontal direction. The operation of the front panel 24 is described below with reference to FIG. 4(*a*), FIG. 4(*b*), and FIG. 4(*c*). FIG. 4(*a*), FIG. 4(*b*), and FIG. 4(*c*) are side views of the indoor unit 2.

In a state wherein the operation of the indoor unit 2 stops, the first panel 240 and the second panel 241 close the outlet 26 and the first inlet 27, and the first panel 240, the second panel 241, and the third panel 242 are disposed parallel to the vertical direction in a substantial linear array as seen in a side view, as depicted in FIG. 4(*a*). In addition, the front sides of the first panel 240, the second panel 241, and the third panel 242 are substantially flat.

When the operation of the indoor unit 2 is initiated, the first panel 240 and the second panel 241 move and cause the outlet 26 and the first inlet 27 to open.

The first panel 240 moves upward parallel to the vertical direction to open the outlet 26, as depicted in FIG. 4(*b*). When the first panel 240 moves upward in the vertical direction, the top end of the first panel 240 is inserted in the gap at the back of the third panel 242. If the first panel 240 moves further upward, the first panel 240 enters the gap between the third panel 242 and the casing main body 23, and is obscured from view at the back of the third panel 242, as depicted in FIG. 4(*c*). Specifically, this results in a state wherein almost the entire first panel 240 overlaps the third panel 242.

The second panel 241 also moves in conjunction with the movement of the first panel 240. The second panel 241 moves forward and also rotates around an axis parallel to the transverse direction as viewed from the front, as depicted in FIG. 4(*b*). The second panel 241 rotates around the lower end so that the upper end is tilted towards the front. The second panel 241 moves further to form a gap between the casing main body 23 and the second panel 241, as depicted in FIG. 4(*c*). The first inlet 27 is thereby opened. Air is then suctioned in from the gap between the upper end of the second panel 241 and the casing main body 23, and air is suctioned into the casing main body 23 from the first inlet 27.

When the front panel 24 moves to open the outlet 26 and first inlet 27, the horizontal flap 29 (see FIG. 2) rotates and moves to an outlet angle corresponding to a set operation mode.

In addition, when the operation of the indoor unit 2 stops, the first panel 240 and the second panel 241 move in an opposite manner to that described above and return to a flat state.

Method for Manufacturing the Indoor Unit of an Air Conditioner

Next, the method for manufacturing the indoor unit 2 of the air conditioner 1 will be described.

Figure 5:
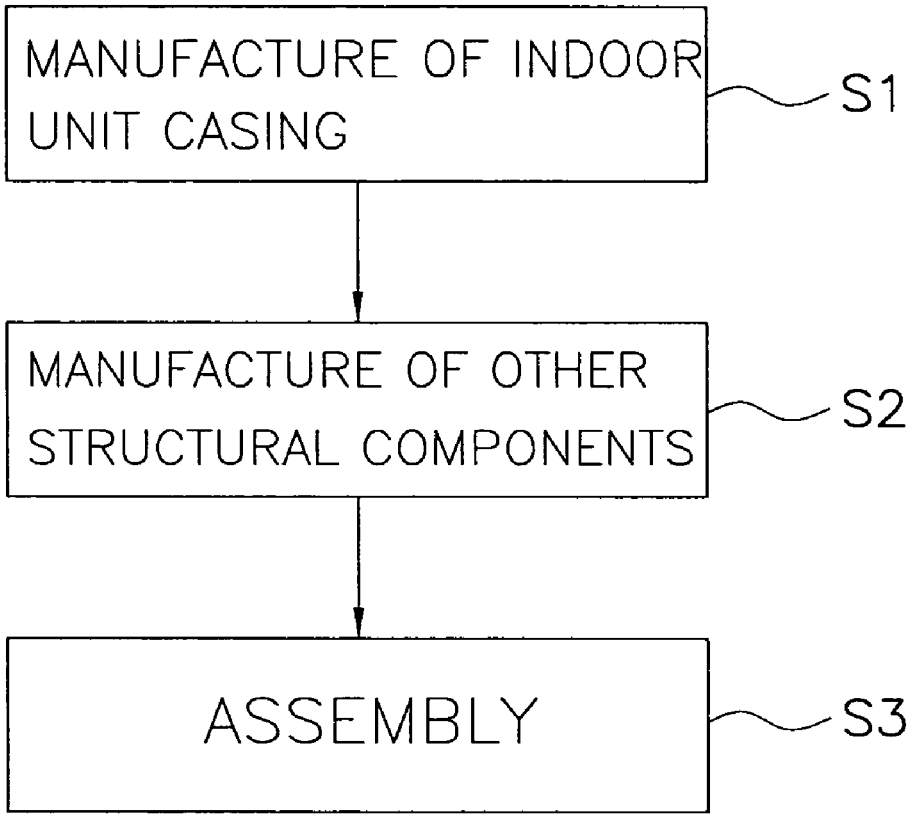
FIG. 5 is a flowchart depicting the method for manufacturing the indoor unit of an air conditioner.

The method for manufacturing the indoor unit 2 of the air conditioner 1 primarily comprises step S1 for manufacturing an indoor unit casing 4, step S2 for manufacturing another structural component, and an assembly step S3, as depicted in FIG. 5.

Figure 6:
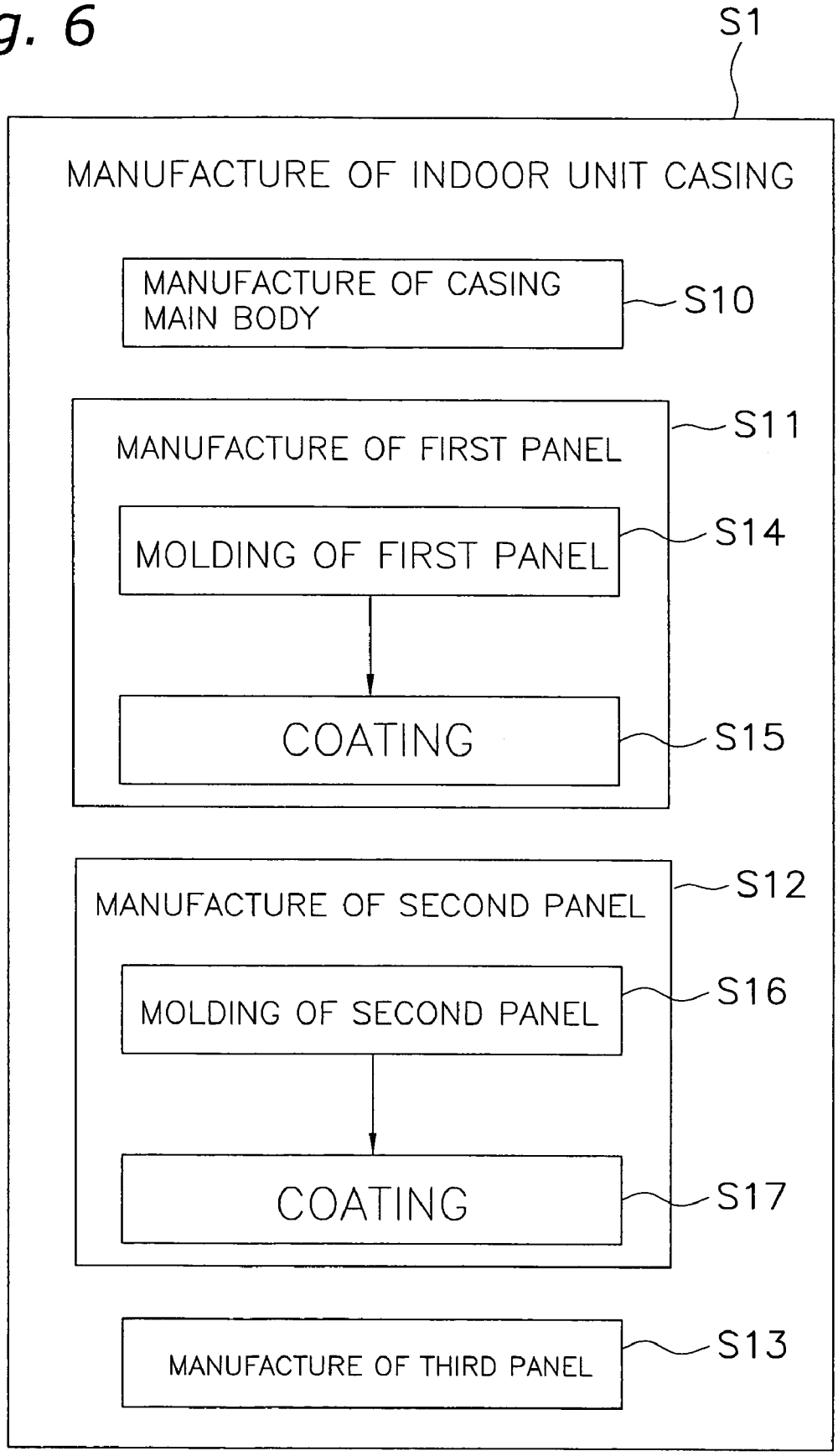
FIG. 6 is a flowchart depicting the method for manufacturing the indoor unit casing.

Step S1 for manufacturing the indoor unit casing 4 has a step S10 for manufacturing the casing main body 23, a step S11 for manufacturing the first panel 240, a step S12 for manufacturing the second panel 241, and a step S13 for manufacturing the third panel 242, as depicted in FIG. 6.

In step S10 for manufacturing the casing main body 23, the casing main body 23 is manufactured by assembling a plurality of molded articles. The molded articles are molded from a nontransparent resin material.

Step S11 for manufacturing the first panel 240 is composed of a step S14 for molding the first panel 240 and a coating step S15. In step S14 for molding the first panel 240, the first panel 240 is molded from a transparent resin material in which pearls or other such luminous grains 45 have been admixed, and the luminous and transparent first panel 240 is manufactured. In step S15 for coating the first panel 240, a base color coating that also has a concealing function is applied to the first panel 240. In this coating step S15, the base color coating is applied from the reverse side of the first panel 240, and the coating material is applied to the entire reverse side of the first panel 240. As a result of this coating step S15, a coating layer 43 that exhibits a color scheme or pattern is bonded to the reverse side of the first panel 240.

Step S12 for manufacturing the second panel 241 is composed of a step S16 for molding the second panel 241 and a coating step S17. In step S16 for molding the second panel 241, the second panel 241 is molded from a transparent resin in which pearls or other such luminous grains 48 have been admixed, and the luminous and transparent second panel 241 is manufactured, in the same manner as in step S14 for molding the first panel 240. In step S17 for coating the second panel 241, a base color coating that also has a concealing function is applied to the second panel 241. In this coating step S17, the base color coating is applied from the reverse side of the second panel 241, and the coating material is applied to the entire reverse side of the second panel 241, in the same manner as in step S15 for coating the first panel 240. As a result of this coating step S17, a coating layer 46 that exhibits a color scheme or pattern is bonded to the reverse side of the second panel 241.

Transparent ABS or polystyrene, for example, can be used as the transparent resin material for molding the first panel 240 and the second panel 241. In addition, aside from pearl grains, glass grains or metallic grains or the like can be used as the luminous grains 45 and 48. Furthermore, the coating step can be replaced with a printing step for performing printing on the reverse side of the first panel 240 or second panel 241, or a film that has a design can be bonded.

In step S13 for manufacturing the third panel 242, the third panel 242 is molded from a nontransparent resin material.

In addition, in step S2 for manufacturing the other structural component depicted in FIG. 5, the indoor heat exchanger 20, the indoor fan 21, various filters, and other structural components of the indoor unit 2 are manufactured.

In the assembly step S3, the indoor unit casing 4 is assembled by combining the casing main body 23, the first panel 240, the second panel 241, and the third panel. In addition, the structural components described above are placed inside the indoor unit casing 4, completing the indoor unit 2.

Features (1)

In the indoor unit 2 of the air conditioner 1, coating layers 43 and 46 that exhibit a color scheme or pattern are provided on the reverse sides of the first panel 240 and second panel 241 formed from a transparent resin material. Therefore, in the indoor unit 2 of the air conditioner 1, the color scheme or pattern or other such design can be seen from the outside through the transparent resin layers 44 and 47 of the first panel 240 and second panel 241. In addition, luminous grains 45 and 48 are admixed into the transparent resin that forms the base of the first panel 240 and second panel 241. Therefore, the outward appearance of the indoor unit 2 exhibits a luminous design, and the aesthetics are improved.

Such a luminous design can be provided to the first panel 240 and second panel 241 not only by coating the first panel 240 and second panel 241 with the grains 45 and 48, but also by molding the first panel 240 and second panel 241 using a transparent resin in which the grains 45 and 48 have been admixed. Therefore, in step S11 for manufacturing the first panel 240 or step S12 for manufacturing the second panel 241 (*1), the steps for applying the grains 45 and 48 can be omitted. Consequently, the finishing of the first panel 240 and the second panel 241 provided with a luminous design can be accomplished with fewer manufacturing steps.

(2)

A luminous design can be provided to the first panel 240 and second panel 241 by using the luminous grains 45 and 48 as described above, but the luminosity can be further improved by using a luminous color scheme of silver or the like as the base color applied to the reverse side of the first panel 240 and second panel 241. Specifically, a design with even greater luminosity can be exhibited in the indoor unit 2 as a result of combining the luminosity from the grains 45 and 48 and the luminosity from the coating layers 43 and 46.

(3)

In this indoor unit 2 of the air conditioner 1, the casing main body 23 is molded from a nontransparent resin material, the first panel 240 and second panel 241 are molded from a transparent resin material in which the grains 45 and 48 have been admixed, and a coating is applied to the reverse sides thereof. Specifically, the first panel 240 and second panel 241 that are disposed on the front of the indoor unit 2 and that can be easily seen by the occupants are improved particularly in terms of their aesthetics, and the casing main body 23 is molded from a nontransparent resin material that can be manufactured at a relatively low cost. Therefore, the aesthetics of the indoor unit 2 can be improved, and the cost of the entire indoor unit 2 can be prevented from increasing.

Other Embodiments

In the embodiment described above, the first panel 240 and second panel 241 are molded from a transparent resin in which grains 45 and 48 have been admixed. Another possibility is for only part of the first panel 240 and second panel 241 to be molded from a transparent resin material in which the grains 45 and 48 have been admixed. In addition, sections other than the first panel 240 and the second panel 241, that is, the entire indoor unit casing 4, may also be molded from a transparent resin in which grains 45 and 48 have been admixed. However, as described above, it is preferable in terms of reducing costs to mold only the first panel 240 and the second panel 241 from a transparent resin in which grains 45 and 48 have been admixed.

INDUSTRIAL FIELD OF APPLICATION

The present invention has the effect of reducing the number of steps for manufacturing an indoor unit of an air conditioner that exhibits a luminous design, and is useful as the indoor unit of an air conditioner.

What is claimed is:

1. An indoor unit of an air conditioner, comprising:

a casing having a front panel disposed on a front side of the casing, the front panel being formed from a transparent material in which luminous grains are mixed;

a fan being disposed in the casing;

an outlet, the fan blowing air into a room through the outlet from the casing; and a design layer with a color scheme or a pattern provided on a reverse side of the front panel.

2. The indoor unit as recited in claim 1, wherein a front side of the front panel is substantially flat.

3. The indoor unit as recited in claim 1, wherein the casing has a casing main body formed from a nontransparent material and disposed separately from the front panel.

4. The indoor unit as recited in claim 1, wherein the design layer exhibits a luminous color scheme.

5. A method for manufacturing an indoor unit of an air conditioner, comprising:

forming a front panel of a casing from a transparent material in which luminous grains are mixed on a front side of the casing;

disposing a fan in the casing;

forming an outlet such that the fan blows air into a room through the outlet from the casing; and providing a design layer with a color scheme or a pattern on a reverse side of the front panel.

6. The indoor unit as recited in claim 2, wherein the casing has a casing main body formed from a nontransparent material and disposed separately from the front panel.

7. The indoor unit as recited in claim 6, wherein the design layer exhibits a luminous color scheme.

8. The indoor unit as recited in claim 3, wherein the design layer exhibits a luminous color scheme.

9. The indoor unit as recited in claim 2, wherein the design layer exhibits a luminous color scheme.

* * * * *